US011577942B2

(12) United States Patent
Urban

(10) Patent No.: US 11,577,942 B2
(45) Date of Patent: Feb. 14, 2023

(54) MOBILE CRANE

(71) Applicant: Tadano Demag GmbH, Zweibrücken (DE)

(72) Inventor: Christian Moritz Urban, Zweibrücken (DE)

(73) Assignee: Tadano Demag GmbH, Zweibrücken (DE)

( * ) Notice: Subject to any disclaimer, the term of this patent is extended or adjusted under 35 U.S.C. 154(b) by 35 days.

(21) Appl. No.: 17/129,104

(22) Filed: Dec. 21, 2020

(65) Prior Publication Data

US 2021/0188601 A1 Jun. 24, 2021

(30) Foreign Application Priority Data

Dec. 23, 2019 (DE) ..... 102019135717.9

(51) Int. Cl.
*B66C 23/78* (2006.01)
*B66C 23/80* (2006.01)

(52) U.S. Cl.
CPC ..... *B66C 23/80* (2013.01); *B66C 23/78* (2013.01); *B66C 2700/0378* (2013.01)

(58) Field of Classification Search
CPC ..... B66C 23/78; B66C 2700/0378
See application file for complete search history.

(56) References Cited

U.S. PATENT DOCUMENTS 2,370,661 A * 3/1945 Hayes ..... B66C 9/14 254/300
2,914,194 A * 11/1959 Brown ..... B66C 23/78 280/755
3,125,352 A * 3/1964 Gouin ..... B62D 37/00 280/763.1
4,394,913 A * 7/1983 Lanning ..... B66C 23/78 280/765.1
4,444,416 A * 4/1984 Soderstrom ..... B66C 23/78 212/302
4,723,667 A 2/1988 Zimmerman
(Continued)

FOREIGN PATENT DOCUMENTS

CN 202098994 U 1/2012
CN 104909312 A 9/2015
(Continued)

*Primary Examiner* — Sang K Kim
*Assistant Examiner* — Nathaniel L Adams
(74) *Attorney, Agent, or Firm* — Gardner, Linn, Burkhart & Ondersma LLP

(57) ABSTRACT

A vehicle crane having a lower carriage with a longitudinal axis and a superstructure that is rotatable about a vertical axis includes at least one base support and at least two side supports arranged on the lower carriage, where the base support and the side supports can be supported with respect to the ground. The two side supports are each arranged on the lower carriage via a support carrier and oppositely in relation to the longitudinal axis of the lower carriage, and precisely two side supports are arranged on the lower carriage. Each base support is arranged oppositely with respect to the two side supports in relation to the vertical axis and as seen in the direction of the longitudinal axis, and a rotary connection support for the superstructure is arranged on the lower carriage and the two support carriers are arranged remotely from the rotary connection support.

12 Claims, 4 Drawing Sheets

(56) References Cited

U.S. PATENT DOCUMENTS

| | | | | | |
|---|---|---|---|---|---|
| 6,142,180 | A * | 11/2000 | Woodling | ..... | B66F 11/046<br>141/387 |
| 2007/0089925 | A1 * | 4/2007 | Addleman | ..... | B66D 1/46<br>180/313 |

FOREIGN PATENT DOCUMENTS

| | | | | | |
|---|---|---|---|---|---|
| DE | 447998 | C * | 8/1927 | ..... | B66C 23/78 |
| DE | 3143801 | A1 | 6/1982 | | |
| DE | 3635328 | A1 | 4/1988 | | |
| DE | 102007030107 | A1 * | 1/2009 | ..... | B60S 9/12 |
| DE | 102014209564 | A1 | 11/2015 | | |
| WO | 2006045609 | A1 | 5/2006 | | |

* cited by examiner

MOBILE CRANE

CROSS REFERENCE TO RELATED APPLICATION

The present application claims priority from German patent application no. 10 2019 135 717.9, filed on Dec. 23, 2019.

BACKGROUND AND FIELD OF THE INVENTION

The invention relates to a vehicle crane comprising a lower carriage with a longitudinal axis and a superstructure which is arranged on the lower carriage and is rotatable about a vertical axis, comprising at least one base support arranged on the lower carriage, at least two side supports arranged on the lower carriage, wherein the base support and the side supports can be supported with respect to a ground, the at least two side supports are each arranged on the lower carriage via a support carrier and oppositely in relation to the longitudinal axis of the lower carriage, and wherein precisely two side supports are arranged on the lower carriage.

The stability of a vehicle crane depends significantly upon its standing surface and the vehicle crane mass. Typically, the standing surface which is predetermined by the width of its running gear unit is not sufficient, at least when picking up a load located to the side of the vehicle crane to reliably absorb the resulting tilting moment and to reliably divert said moment into the ground at that point. Moreover, the flexibility of the running gear unit, especially during dynamic movements, can cause uncontrollable movements which put the stability of the vehicle crane at risk. In particular, for the reasons stated its standing surface which is determined by the design can generally be changed, usually by means of lateral supports. Furthermore, the crane mass which is established by the design can be adapted to the respective usage purpose by incorporating at least one crane weight. The aim in this case is to keep the center of gravity of the crane, which changes when a load is being picked up, within specific limits such that its standing moment is always above the load-dependent tilting moment.

SUMMARY OF THE INVENTION

The present invention provides a vehicle or mobile crane with a lower carriage such that it is on the whole lighter and more cost-effective in spite of its stability, which is increased via supports.

In accordance with an embodiment of the present invention, in the case of a vehicle crane comprising a lower carriage with a longitudinal axis and a superstructure which is arranged on the lower carriage and is rotatable about a vertical axis, comprising at least one base support arranged on the lower carriage, at least two side supports arranged on the lower carriage, wherein the base support and the side supports can be supported with respect to the ground, the at least two side supports are each arranged on the lower carriage via a support carrier and oppositely in relation to the longitudinal axis of the lower carriage, and the at least one further base support is arranged opposite to the at least two side supports with respect to the vertical axis, wherein precisely two side supports are arranged on the lower carriage, a lighter and more cost-effective design is achieved in spite of its stability, which is increased via the base support and the side supports, by virtue of the fact that each base support is arranged oppositely with respect to the at least two side supports in relation to the vertical axis and as seen in the direction of the longitudinal axis, and a rotary connection support for the superstructure is arranged on the lower carriage and the two support carriers are arranged remotely from the rotary connection support. An aspect of the invention is that of keeping in each case to the reduction in the number of side supports with a support carrier to a total of two. In particular, in the case of short vehicle cranes a maximum amount of installation space can thus be achieved in the region of the rotary connection support.

In an advantageous manner, provision is made and a definition of the term "remotely" indicates that, as seen in the direction of the longitudinal axis, the two support carriers are arranged at a distance of at least 1.5 m from the rotary connection support.

In conjunction with the present invention, a distinction is made between side supports and base supports. The following is to be expressed through the selection of these terms. The side supports are the laterally extendible supports which are typically provided on the vehicle cranes and with which the so-called tilting area of the vehicle crane can be enlarged. The lateral extendibility of the side supports is achieved in general by virtue of the fact that said supports are connected to the lower carriage via a support carrier. In this case, the support carrier is arranged in a displaceable and/or pivotable manner on the lower carriage and furthermore can also be telescopic. Therefore, with the side supports and the associated support carriers, a lateral extendibility of more than 1 m, preferably more than 1.5 m, starting from the outer contour of the lower carriage as seen in plan view, is achieved in order to achieve the desired enlargement of the tilting area of the vehicle crane. This is associated with the fact that the side supports have a corresponding installation size and thus require a corresponding installation space in the region of the lower carriage and involve a corresponding weight.

In contrast to the side supports, the base supports are supports which have a smaller installation size and are therefore able to make only a smaller contribution than the side supports in terms of enlarging the tilting area of the vehicle crane. However, for this purpose the base supports have the advantage that they are more compact and lighter than the side supports. Therefore, these base supports are to be arranged in a positionally fixed manner on or underneath the lower carriage or are to be supported on the lower carriage only via relatively short base carriers. As a result, if the base supports can be pivoted out or folded in laterally or to the rear or front, only small lateral enlargements of the tilting area are achieved. The base supports can be extended with respect to the contour of the lower carriage, as seen in plan view, only over a small distance of no more than 1.5 m, preferably no more than 1 m. The lower end of the typically downwardly extendible base support serves as a reference point for this distance.

The advantage achieved from this can be seen in a naturally lower weight of the vehicle crane together with a reduction in the outlay and cost for its construction and maintenance. Moreover, the specific reduction to only two support carriers frees up installation space which can be used e.g. for installation of the motor and/or further components.

At the same time or alternatively, the vehicle crane needs to have a length smaller than the previously known design, which contributes additionally to its weight reduction and better handling. In fact, this solution is based upon the knowledge that the lower carriage itself can be used as a rigid support carrier, via the at least one base support of which and the two side supports it is already possible to achieve corresponding stability transversely to the longitudinal axis of the lower carriage. The two support carriers which can be put out at an angle to its longitudinal axis are sufficient to ensure the stability around the longitudinal axis of the lower carriage.

Alternatively, the base support and the side supports can also be structures which extend by means of movement mechanisms other than hydraulic cylinders in the direction of the ground and support the lower carriage on the ground. A connection to the ground would also be feasible.

According to a particular aspect of the basic inventive idea, the support carriers can be arranged on the front frame or on the rear frame in such a manner as to be displaceable and/or pivotable relative to support boxes arranged on the lower carriage. Furthermore, the support carriers can telescope one inside the other. Displaceable configurations occasionally have less of a lateral overhang on the vehicle crane than pivotable configurations because in the retracted state they can be accommodated almost completely between the lateral dimensions of the running gear unit. In each case, the support carriers having at least one base support can thus be displaced from a support position to a travel position of the vehicle crane and back in order to obtain the most compact dimensions possible particularly in its travel position.

In a particularly preferred manner, the base supports discussed within the scope of the invention and the side supports can be telescopic support cylinders in order to establish an immediate frictional connection with the ground at that point by reason of the, in particular hydraulic, adaptability of their length. The vehicle crane can come in various designs, such as e.g. a mobile crane which can be driven on roads or an All Terrain (AT) crane.

The invention provides that precisely one base support can be arranged on the lower carriage. As an alternative thereto, precisely two base supports can be arranged on the lower carriage. Therefore, in combination with the precisely two side supports of the support carriers, tilting protection of the vehicle crane is achieved by means of a total of three or four substantially rigid contact surfaces of the base supports and side supports on the ground at that point. In this case, rigid refers to the comparison with the typically spring-mounted running gear unit, via which the vehicle crane stands on the ground in movable manner with respect thereto. The strict reduction in the number of base supports and side supports overall permits an advantageous weight reduction of the vehicle crane while at the same time ensuring sufficient stability in relation to possible tilting.

That said, in the case of the arrangement of two base supports, these supports can be located e.g. together at the front or rear on the lower carriage. In a particular arrangement, the individual base support located on the lower carriage or the two base supports can each be arranged within a longitudinal plane spanned between the vertical axis and a longitudinal axis of the lower carriage. This means essentially that the individual base support or the two base supports spaced apart from one another are then arranged in the longitudinal direction of the lower carriage one behind the other relatively centrally with an offset of about +/−400 mm with respect to the centrally located longitudinal axis, preferably centrally. Accordingly, the individual base support or the two base supports and the vertical axis located in particular in the center of a rotary connection support form a common line. This alignment produces the most balanced behavior possible in relation to the stability transversely to the longitudinal direction of the lower carriage.

In a preferred embodiment, provision is made that precisely one base support or precisely two base supports are arranged on the lower carriage. In the case of precisely two base supports, they are aligned, as seen in plan view of the lower carriage, symmetrically with respect to the longitudinal axis of the lower carriage. On the whole, the vehicle crane in this embodiment then has three or four base and side supports. Also, the at least one base support may be preferably arranged in a positionally fixed manner on the lower carriage. This permits a further simplification in relation to costs and weight reduction, in that the usual two support carriers can be omitted because the at least one base support on the lower carriage then cannot be extended in a movable manner, such as e.g. laterally. In this case, the one base support or the base supports is/are arranged on the lower carriage, preferably underneath the lower carriage. In this case, the lower end of the typically downwardly extendible base support also serves as a reference point.

In an advantageous embodiment, provision is made that at least one or each base support is arranged on the lower carriage so as to be foldable or pivotable via a base carrier. The desired compact construction is achieved thereby or by relatively short base carriers. In this case, it is preferred that at least the one or each base support is arranged on the lower carriage so as to be foldable about a horizontal axis or pivotable about a vertical axis.

The tilting area of the vehicle crane can also be enlarged by virtue of the fact that the at least one or each base support for providing support with respect to the ground can be extended vertically or at an angle in the range of 0 to 45°, preferably 15 to 30°, with respect to a vertical. As a result, a support plate which is typically fastened to the lower end of the base support moves to a position further away from the center of gravity of the lower carriage in contact with the ground.

In connection with the foregoing, it is considered to be particularly advantageous if the two support carriers are located in the region of a free end of the lower carriage. In this connection, as seen in the longitudinal direction of the lower carriage, the region is considered to be the region from the front or rear edge to in each case 1 m inwards. The lower carriage is also understood in relation to its carrying portion. Accordingly, a driver's cabin which is mounted on the front end of the lower carriage is not to be ascribed to the lower carriage.

In a preferred embodiment, the lower carriage consists of a front frame and a rear frame, between which the pot is arranged. The pot carries the rotary connection support. The resulting advantages have already been explained in conjunction with the vehicle crane in accordance with the invention so that at this juncture to avoid repetition reference is made to the corresponding statements relating thereto.

The present invention is particularly suitable for a vehicle or mobile crane, on the superstructure of which a telescopic main jib is arranged in a luffable manner.

An exemplified embodiment of the invention will be explained in greater detail in the below description.

DESCRIPTION OF THE PREFERRED EMBODIMENTS

Figure 1:
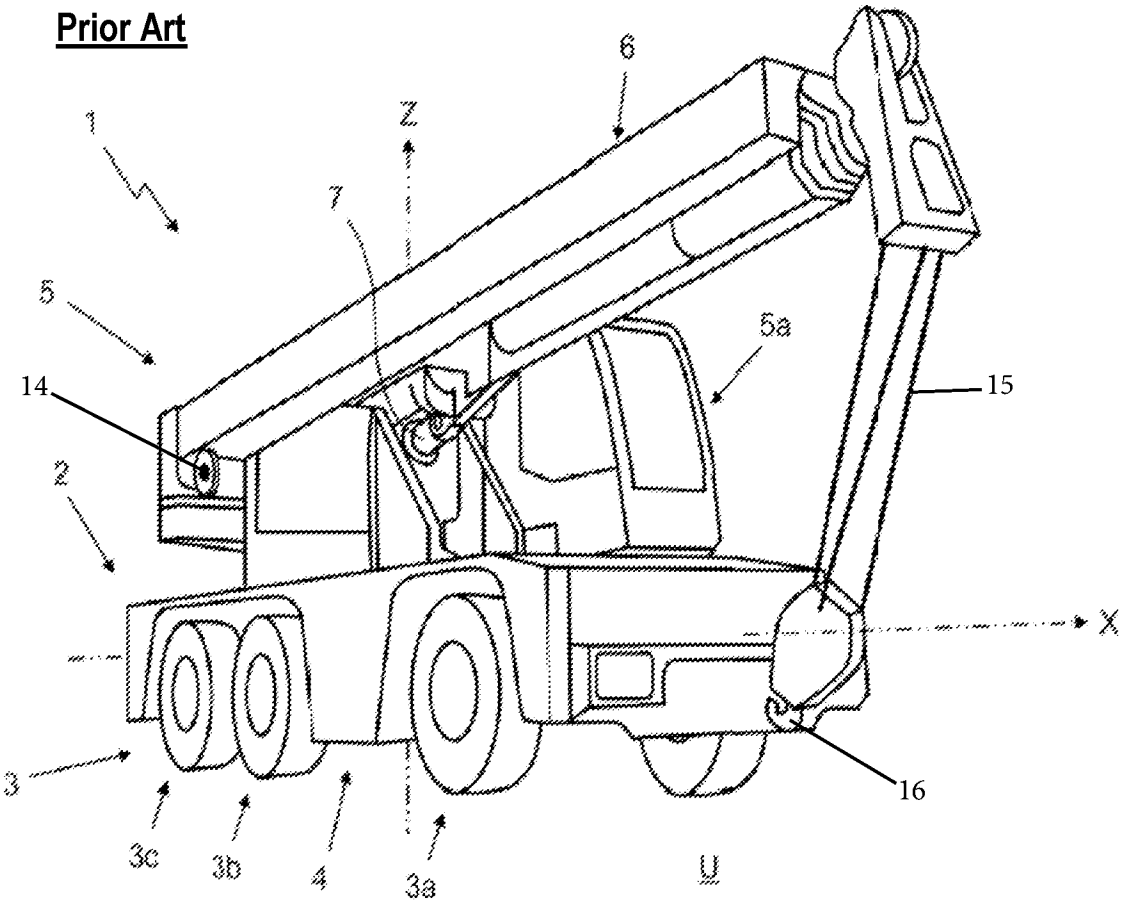
FIG. 1 shows a vehicle crane from the prior art in a schematic perspective view.

FIG. 1 illustrates the schematic view of a vehicle crane 1, which can travel on roads, from the prior art. The vehicle crane 1 comprises a lower carriage 2 which has a running gear unit 3 with three running gear unit axles 3*a*, 3*b*, 3*c* by way of example in this case. These running gear unit axles 3*a*, 3*b*, 3*c* which extend in relation to a longitudinal axis X of the lower carriage 2 transversely and in this respect in parallel with a transverse axis Y of the lower carriage 2 and are not directly visible owing to the illustration are arranged one behind the other along the longitudinal axis X. At the opposite ends of the running gear unit axles 3*a*, 3*b*, 3*c*, in each case at least one rubber-tired wheel is rotatably arranged, via which the vehicle crane 1 is supported so as to be movable on a ground U. As cannot directly be seen here but as can be seen in the further FIGS. 2 and 3, the lower carriage 2 has a pot 4, on which a superstructure 5 is mounted and is rotatable about a vertical axis Z. Purely by way of example, the pot 4 is located between the one front running gear unit axle 3*a* and its two rear running gear unit axles 3*b*, 3*c*. Contrary to what is illustrated here, the lower carriage 2 can of course also have only two or more than three running gear unit axles 3*a*, 3*b*, 3*c*, wherein the pot 4 is then located in a correspondingly suitable manner between two of these running gear unit axles 3*a*, 3*b*, 3*c*. Furthermore, a telescopic main jib 6 is arranged on the superstructure 5, the state of said main jib which is retracted in the present case being reduced in the illustration substantially to its basic box, whereas its inner boxes which can be displaced with respect thereto and relative to one another are arranged in a correspondingly concealed manner within the basic box. The main jib 6 is luffably supported on the superstructure 5 such that it can be luffed about a substantially horizontal axis via at least one luffing cylinder 7 which is only indicated in this case. The vehicle crane 1 includes a lifting winch 14 connected to lifting cable 15 that runs along the main jib 6 to a hook 16. It can be seen that the superstructure 5 in the embodiment shown here by way of example has a driver's cabin 5*a*.

Figure 2:
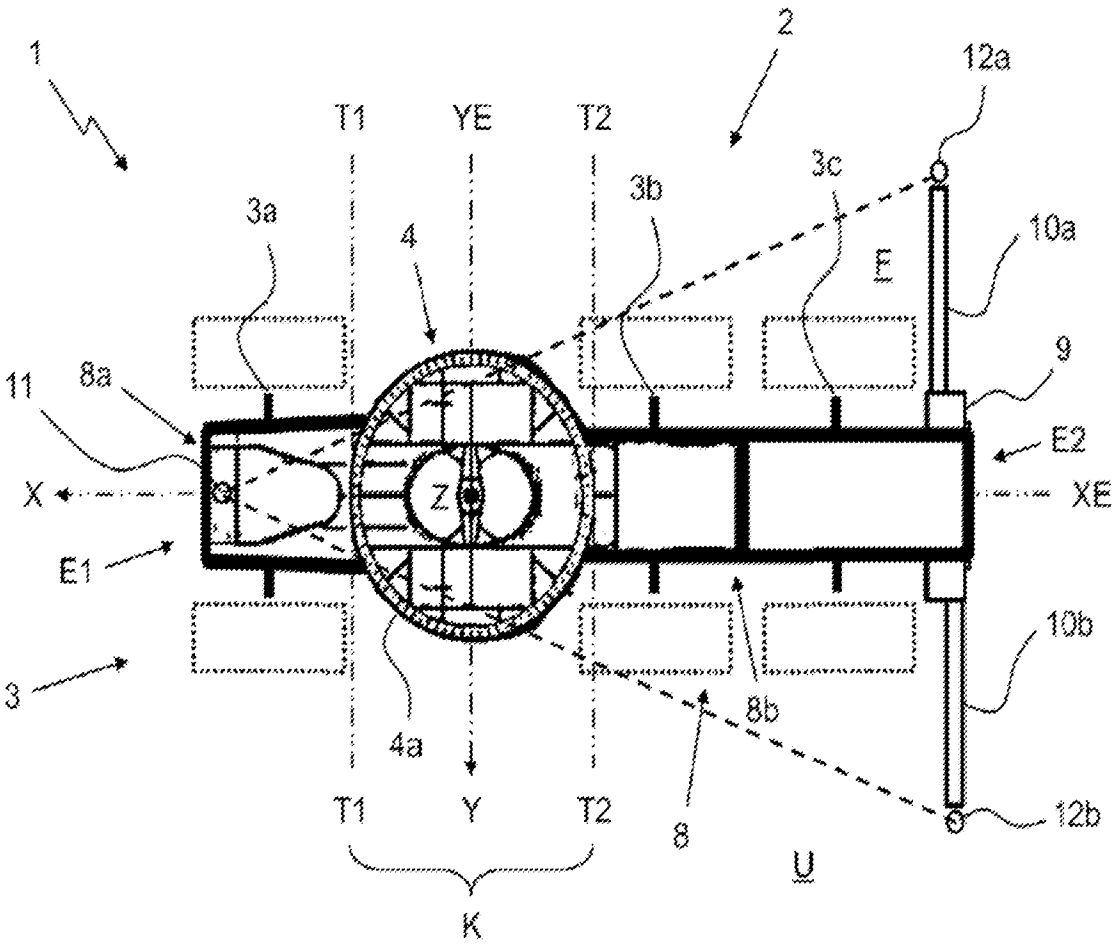
FIG. 2 shows a schematic top view of an inventive lower carriage for a vehicle crane having support carriers located in a support position.

FIG. 2 shows an inventive lower carriage 2 for a vehicle crane 1 or a vehicle crane 1 which is reduced to its inventive lower carriage 2. In this case, the number of running gear unit axles 3*a*, 3*b*, 3*c* and the position of the pot 4 have also been selected purely by way of example for illustrative purposes. The further components of the vehicle crane 1 and/or of the lower carriage 2 which are not illustrated in greater detail in this case can correspond to the embodiment and arrangement already shown in FIG. 1. In particular, by reason of the view of the lower carriage 2 in accordance with the invention which in this case is reduced to a purely schematic top view—in addition to the regions which cannot be seen or cannot be seen easily due to being concealed—the features which are essential to the invention can be seen more easily.

The lower carriage 2 comprises a basic framework 8 which has a front frame 8*a* and a rear frame 8*b*. It can be seen that the pot 4 is arranged between the front frame 8*a* and the rear frame 8*b* or at least partially in the basic framework 8. The pot 4 thus forms a part of the basic framework 8, to which the front frame 8*a* and rear frame 8*b* are connected opposite one another along the longitudinal axis X. Alternatively to what is shown here, it is also feasible for the pot 4 to rest on the front frame 8*a* and/or the rear frame 8*b* and for said pot to be able to be arranged at least partially in the front frame 8*a* and/or in the rear frame 8*b*. This embodiment is also intended to be covered by the feature that the pot 4 is arranged between the front frame 8*a* and rear frame 8*b*.

The pot 4 has, at its upper end in the direction of the vertical axis Z, a circumferential rotary connection support 4*a* which typically corresponds to a rotary connection, not illustrated in greater detail here, for the superstructure 5. In the present case, a bearing block 9 which can be part of the basic framework 8 is arranged in the region of a free end E2 of the rear frame 8*b*. Arranged on the bearing block 9 are two support carriers 10*a*, 10*b* which, in the embodiment shown here, are supported in or on the bearing block 9 in such a manner as to be linearly retractable and extendible. In the present case, both support carriers 10*a*, 10*b* are located in their support position, in which in an extended state they extend in parallel with the transverse axis Y of the lower carriage 2.

In the illustrated embodiment, the lower carriage 2 comprises on the whole one base support 11 and two side supports 12*a*, 12*b*, of which in each case one side support 12*a*, 12*b* is arranged in the region of the respective free end of the two support carriers 10*a*, 10*b*. Specifically, the side support 12*a* is arranged on the support carrier 10*a* on the left in relation to the view of FIG. 2, whereas the side support 12 is fixed to the support carrier 10*b* on the left with respect thereto. In the present case, the further base support 11 is arranged on the front frame 8*a*. Alternatively, two base supports 11 can be arranged—in a manner not shown in greater detail—on the basic framework 8 and are then located either together or separate from one another on the front frame 8*a* and/or on the rear frame 8*b*. If in each case one base support 11 is arranged on the front frame 8*a* and a further base support 11 is arranged on the rear frame 8*b*, they can be oriented in their position preferably along or at least in the region of the longitudinal axis X. The base supports 11 and side supports 12*a*, 12*b* which extend e.g. in parallel with the vertical axis Z are, in a manner not shown in greater detail, hydraulically variable in length and thus are vertically retractable and extendible such that the lower carriage 2 can be supported thereby, in addition to its running gear unit 3, with respect to the ground U. In contrast to the—in this case longitudinally displaceable—configuration of the support carriers 10*a*, 10*b*, they can e.g. also be arranged pivotably on the basic framework 8 in a manner not shown in greater detail. Combinations of the foregoing are likewise feasible. In each case, the side supports 12*a*, 12*b* arranged on the support carriers 10*a*, 10*b* can thus be displaced between a travel position close to the basic framework 8 and a support position which, in contrast thereto, is remote from the basic framework 8. In the travel position, the side supports 12*a*, 12*b* are located as closely as possible on the basic framework 8 and are raised from the ground U such that the vehicle crane 1 is freely movable.

Figure 3:
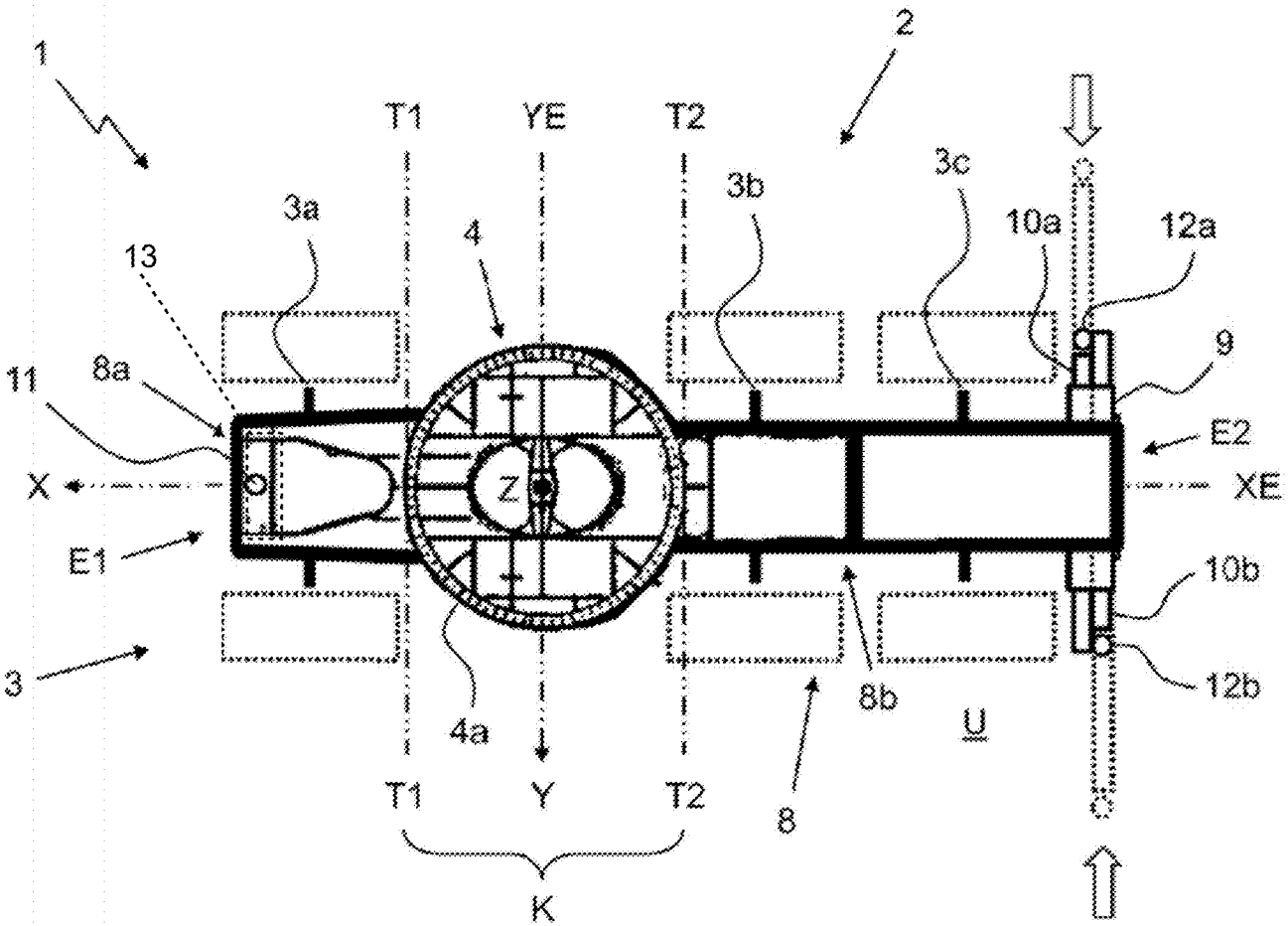
FIG. 3 shows an otherwise unchanged view of the lower carriage of FIG. 2 having support carriers which are changed from the support position to a travel position.

The position of the support carriers 10*a*, 10*b* shown in FIG. 2, and also in FIG. 3, is selected purely by way of example and alternatively can be located e.g. also in the region of a free end E1 of the front frame 8*a*, while the base support 11 can then be located on the rear frame 8*b*.

Basically, the support carriers 10*a*, 10*b* are always located outside the region of the pot 4 or the rotary connection support 4*a*, in particular outside a corridor K of the lower carriage 2 which will be described in greater detail hereinafter.

Spanned between the vertical axis Z and the longitudinal axis X of the lower carriage 2 is a longitudinal plane XE which in this respect is perpendicular to the top view plane. Preferably, the at least one base support 11 can be arranged within this longitudinal plane XE and can extend therein. Furthermore, the vertical axis Z located in the center of the pot 4 and the transverse axis Y of the lower carriage 2 extending at a right angle to the longitudinal axis X of the lower carriage 2 span a transverse plane YE there between which in this respect is likewise perpendicular to the top view shown in this case. Accordingly, the vertical axis Z extends precisely along the section between the longitudinal plane XE and the transverse plane YE. Extending in parallel with the transverse plane YE are two tangential planes T1, T2 which lie tangentially in each case on a region of the pot 4 or its rotary connection support 4*a* facing the front frame 8*a* and on a region thereof facing the rear frame 8*b*. The two tangential planes T1, T2 include there between the corridor K already discussed above, wherein the two support carriers 10*a*, 10*b* in accordance with the invention are arranged essentially outside this corridor K. In relation to the purely exemplified view of FIG. 2 and FIG. 3, the two support carriers 10*a*, 10*b* are spaced far apart from said corridor K. In contrast thereto, they can of course also be arranged in a manner moved closer to the corridor K in a manner not shown, wherein they are always located outside the corridor K.

Between the base support 11 located in the region of the front frame 8*a* and the two side supports 12*a*, 12*b* located in the rear region of the rear frame 8*b* on the extended support carriers 10*a*, 10*b* there is formed an imaginary triangular tilting area F which imparts to the vehicle crane 1 the stability in relation to occurring tilting moments, which is required during its use, in particular when picking up and manipulating a load. By reason of the support carriers 10*a*, 10*b*, of which there are only two in accordance with the invention, the omission of otherwise typical installation regions for additional support carriers means that there is considerably more installation space available on the basic framework 8, e.g. for motor installation.

Figure 4:
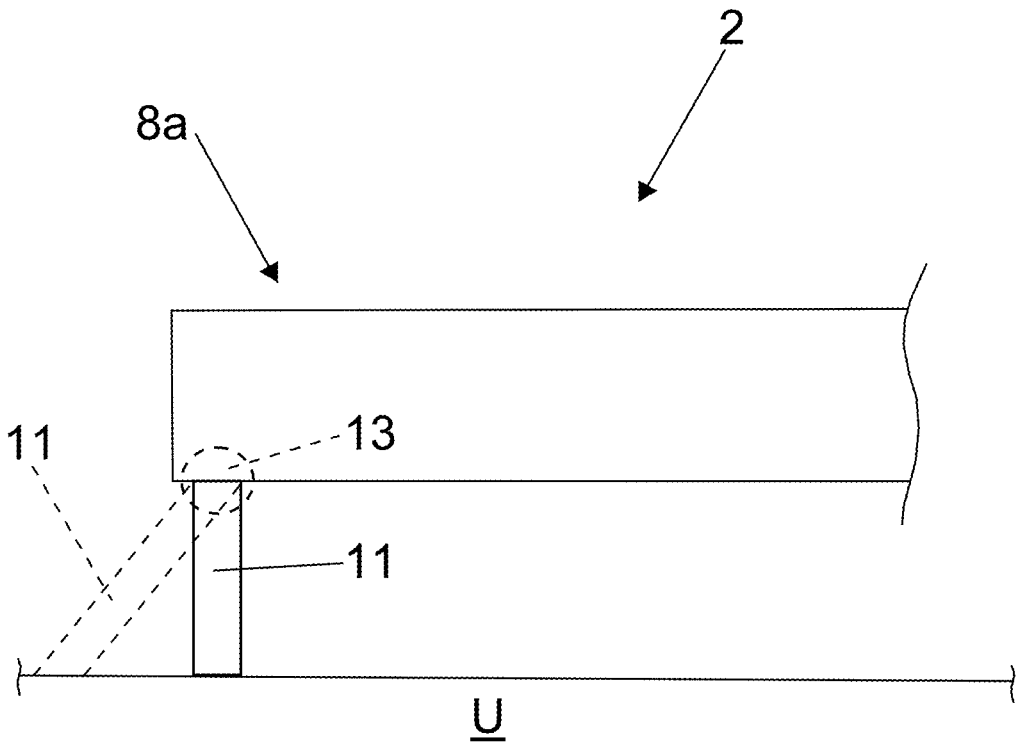
FIG. 4 shows a side elevation view of a portion of the lower carriage of FIG. 2.

In a preferred embodiment, the at least one base support 11 cannot be displaced and in this respect is arranged in a positionally fixed manner on the basic frame 8. Of course, this does not include a vertical or oblique extension of this at least one base support 11. By means of this oblique extension, a further enlargement of the tilting area of the vehicle crane can be achieved because in this case the respective base support 11 for providing support with respect to the ground U is extended at an angle in the range of more than 0 to 45°, preferably 15 to 30°, with respect to a vertical (FIG. 4). As a result, a support plate which is typically fastened to the lower end of the base support 11 moves to a position further away from the centre of gravity of the lower carriage 2 in contact with the ground U.

Alternatively, at least one of the base supports 11 can, however, also be connected to the basic framework 8 of the lower carriage 2 in a manner not shown in greater detail, e.g. via an additional relatively short base carrier 13 (FIG. 3). This at least one base carrier 13 can be articulated in a manner pivotable about a vertical axis or horizontal axis, which then means that the at least one base support 11 is advantageously displaceable via the base carrier 13. In particular, in the case of the alternative arrangement of two base supports 11 on the lower carriage 2, in particular on its front frame 8*a* or rear frame 8*b*, it can be advantageous in terms of an enlargement of the tilting area F and at the same time a simple construction to configure the base supports 11 to be displaceable, as described above. By virtue of the arrangement of at least two base supports 11 together on the front frame 8*a* and/or rear frame 8*b*, the otherwise triangular tilting area F can be expanded to form a trapezium, whereby in particular improved deformation properties, such as e.g. less rotation and/or bending, of the lower carriage 2 can be achieved. In the folded-out or pivoted-out state, the precisely two base supports are then aligned, as seen in the plan view of the lower carriage 2, symmetrically with respect to the longitudinal axis X of the lower carriage 2.

FIG. 3 shows the view of FIG. 2 with support carriers 10*a*, 10*b* (travel position) now retracted into the bearing block 9 in the direction of the indicated arrows. It can be seen that for this purpose they slide laterally past one another in a plane extending substantially in parallel with the ground U. Alternatively, in an embodiment not shown here the two support carriers 10*a*, 10*b* can extend coaxially with respect to one another, which, however, reduces their support length in relation to the bearing block 9 and/or requires on the whole a short installation length of the support carriers 10*a*, 10*b* in order to achieve the most compact dimensions possible in the retracted state. By virtue of the preferably continuously linear displaceability of the support carriers 10*a*, 10*b*, the shape of the tilting area F as a whole can be changed in order, where required, to be able to make possible adaptations to the respective requirements in relation to the stability of the vehicle crane 1.

The inventive reduction to only two support carriers 10*a*, 10*b* means that fewer primary support carriers have to be transported and undergo maintenance, which contributes in particular to an advantageous weight reduction. The installation space thus gained through the omission of corresponding bearing blocks for connecting further support carriers can be used e.g. for reducing the length of the lower carriage 2 and/or for accommodating existing and/or new components of the vehicle crane 1.

The lower carriage 2 shown in the preceding exemplified embodiment is made up of the front frame 8*a*, the pot 4 and the rear frame 8*b*, wherein the pot 4 carries the rotary connection support 4*a*. Fundamentally, it is also feasible for the lower carriage 2 to have a continuous basic frame 8, on which the rotary connection support 4*a* is arranged, with the pot 4 being omitted.

Changes and modifications in the specifically described embodiments can be carried out without departing from the principles of the present invention which is intended to be limited only by the scope of the appended claims, as interpreted according to the principles of patent law including the doctrine of equivalents.

The embodiments of the invention in which an exclusive property or privilege is claimed are defined as follows:

1. A vehicle crane comprising:

a lower carriage with a longitudinal axis and a superstructure that is arranged on the lower carriage and is rotatable about a vertical axis, wherein a telescopic main jib is arranged in a luffable manner on the superstructure;

a lifting winch arranged on the superstructure and connected to a lifting cable running along the telescopic main jib to a hook for lifting and lowering goods;

precisely one base support arranged on the lower carriage or precisely two base supports arranged on the lower carriage and aligned, as seen in the plan view of the lower carriage, symmetrically with respect to the longitudinal axis of the lower carriage; and at least two side supports arranged on the lower carriage;

wherein the base support and the side supports are configured to be supported with respect to the ground, and wherein the at least two side supports are each arranged on the lower carriage via two support carriers and oppositely in relation to the longitudinal axis of the lower carriage, and wherein precisely two side supports are arranged on the lower carriage; and wherein each base support is arranged oppositely with respect to the at least two side supports in relation to the vertical axis and as seen in the direction of the longitudinal axis, and a rotary connection support for the superstructure is arranged on the lower carriage and the two support carriers are arranged remotely from the rotary connection support, and wherein the support carriers are arranged in a displaceable and/or pivotable manner on the lower carriage and/or the support carriers are telescopic;

wherein each base support is arranged within a longitudinal plane spanned between the vertical axis and the longitudinal axis of the lower carriage.

2. The vehicle crane as claimed in claim 1, wherein as seen in the direction of the longitudinal axis the two support carriers are arranged at a distance of at least 1.5 m from the rotary connection support.

3. A vehicle crane comprising:

a lower carriage with a longitudinal axis and a superstructure that is arranged on the lower carriage and is rotatable about a vertical axis;

a telescopic main jib arranged in a luffable manner on the superstructure;

a lifting winch arranged on the superstructure and connected to a lifting cable running along the telescopic main jib to a hook for lifting and lowering goods;

precisely one base support arranged on the lower carriage or precisely two base supports arranged on the lower carriage and aligned, as seen in the plan view of the lower carriage, symmetrically with respect to the longitudinal axis of the lower carriage; and at least two side supports arranged on the lower carriage;

wherein the base support and the side supports are configured to be supported with respect to the ground, and wherein the at least two side supports are each arranged on the lower carriage via a support carrier and oppositely in relation to the longitudinal axis of the lower carriage, and wherein precisely two side supports are arranged on the lower carriage; and wherein each base support is arranged oppositely with respect to the at least two side supports in relation to the vertical axis and as seen in the direction of the longitudinal axis, and a rotary connection support for the superstructure is arranged on the lower carriage and the two support carriers are arranged remotely from the rotary connection support;

wherein each base support is arranged within a longitudinal plane spanned between the vertical axis and the longitudinal axis of the lower carriage.

4. The vehicle crane as claimed in claim 3, wherein as seen in the direction of the longitudinal axis the two support carriers are arranged at a distance of at least 1.5 m from the rotary connection support.

5. The vehicle crane as claimed in claim 3, wherein the support carriers are arranged in a displaceable and/or pivotable manner on the lower carriage and/or the support carriers are telescopic.

6. The vehicle crane as claimed in claim 3, wherein the at least one or each base support is arranged in a positionally fixed manner on the lower carriage.

7. The vehicle crane as claimed in claim 3, wherein the at least one or each base support is arranged underneath the lower carriage.

8. The vehicle crane as claimed in claim 3, wherein the at least one or each base support is arranged on the lower carriage so as to be foldable or pivotable via a base carrier.

9. The vehicle crane as claimed in claim 8, wherein the at least one or each base support is arranged on the lower carriage so as to be foldable about a horizontal axis or pivotable about a vertical axis.

10. The vehicle crane as claimed in claim 3, wherein the at least one or each base support for providing support with respect to the ground can be extended vertically or at an angle in the range of 0 to 45° to a vertical in order to enlarge the tilting area of the vehicle crane.

11. The vehicle crane as claimed in claim 3, wherein the two support carriers are arranged on the lower carriage in the region of a free end of the lower carriage.

12. The vehicle crane as claimed in claim 3, wherein the lower carriage consists of a front frame and a rear frame, between which a pot is arranged.

* * * * *